United States Patent [19]

Klemm

[11] Patent Number: 4,993,644

[45] Date of Patent: Feb. 19, 1991

[54] DEVICE FOR APPLYING WATER-BORNE PAINT BY MEANS OF HIGH-SPEED ROTARY ATOMIZERS OF OTHER APPLICATION SYSTEMS VIA DIRECT CHARGING OR CONTACT CHARGING

[75] Inventor: Horst Klemm, Munster, Fed. Rep. of Germany

[73] Assignee: BASF Lacke & Farben Aktiengesellschaft, Münster, Fed. Rep. of Germany

[21] Appl. No.: 378,213

[22] PCT Filed: Dec. 19, 1987

[86] PCT No.: PCT/EP87/00803

§ 371 Date: Aug. 9, 1989

§ 102(e) Date: Aug. 9, 1989

[87] PCT Pub. No.: WO88/04957

PCT Pub. Date: Jul. 14, 1988

[30] Foreign Application Priority Data

Dec. 24, 1986 [DE] Fed. Rep. of Germany ..... 3644536

[51] Int. Cl.[5] ..... B05B 5/16

[52] U.S. Cl. ..... 239/690

[58] Field of Search ..... 239/690, 691; 361/227, 361/228

[56] References Cited

U.S. PATENT DOCUMENTS 4,275,834 6/1981 Spanjersberg et al. ..... 239/691 X

FOREIGN PATENT DOCUMENTS 901634 8/1945 France .
2572662 5/1986 France .

*Primary Examiner*—Andres Kashnikow
*Assistant Examiner*—William Grant
*Attorney, Agent, or Firm*—Kenyon & Kenyon

[57] ABSTRACT

A paint storage vessel is disclosed which is subdivided by flexible insulation into two interior spaces, each connected to its own distribution line and its own paint supply line. The ring main system is connected to the two distribution lines and is effected with the interposition of an electrically insulating change-over mechanism.

4 Claims, 1 Drawing Sheet

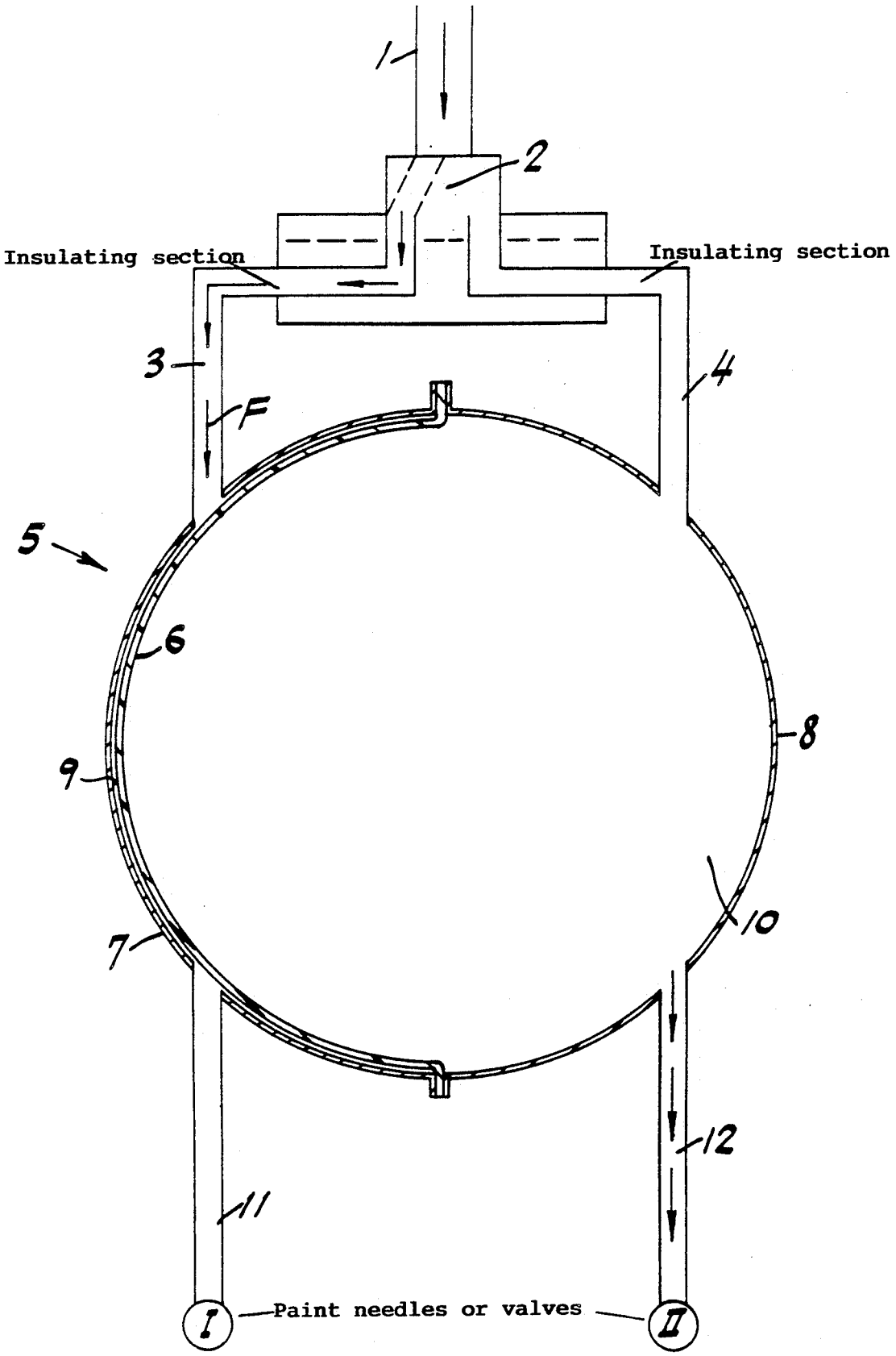
1
2
Insulating section
Insulating section
3
4
F
5
6
8
9
10
7
12
11
I
Paint needles or valves
II

DEVICE FOR APPLYING WATER-BORNE PAINT BY MEANS OF HIGH-SPEED ROTARY ATOMIZERS OF OTHER APPLICATION SYSTEMS VIA DIRECT CHARGING OR CONTACT CHARGING

The invention relates to a device for applying water-borne paint by means of high-speed rotary atomizers via direct charging or contact charging, according to the preamble of the main claim.

For many reasons, so-called water-borne paint systems, which are desirable especially for environmental reasons, are nowadays used increasingly for applying paints.

In contrast to a conventional undercoat or top-coat, the water-borne paint system can, for chemically-physical reasons, not be adjusted to the specific paint resistance normally necessary for an electrostatic process. It is therefore required that the normally grounded paint supply line is electrically isolated from the spray systems which are under a high voltage, in order to prevent, in a manner of speaking, a discharge of the high voltage. For this reason, a so-called external charging system, i.e. so-called external charging, has been adopted, but it was found that the efficiency of deposition was very poor, and this becomes particularly important, especially at high relative atmospheric humidities.

By contrast, direct charging gives better values, but the device for carrying out such direct charging operations is expensive.

In the state of the art, it has been proposed to use two paint storage vessels for direct charging, which are both set up to be insulated from the ground. One paint storage vessel then supplies one or more spray systems via a pump and a so-called booth line, while the other paint storage vessel is designed as an intermediate filling station.

The booth ring main and the first paint storage vessel fitted with a pump are here insulated from the ground and, since this paint storage vessel can take up only a limited quantity of paint material but, on the other hand, so-called continuous operation is desired, it must be replenished when a certain paint level is reached. During normal operation, i.e. application of the paint, the first storage vessel is filled from the ring main with paint material and, during this period, this storage vessel is at ground potential. After the valves have been closed, high-voltage potential is applied to this intermediate vessel which is then filled. Filling of the paint storage vessel fitted with a pump and interim filling of the intermediate vessel here proceed fully automatically.

It can be seen that, with such an arrangement, not only two paint storage vessels must be used, but the installation cost is also considerable.

It is the object of the invention to provide a device for applying water-borne paints by means of high-speed rotary atomizers and so-called direct charging, wherein this investment in machinery, as was required in the state of the art, is avoided.

This object underlying the invention is achieved by the teaching of the main claim.

Advantageous embodiments are detailed in the subclaims.

SUMMARY

The invention described herein encompasses a device for applying water-borne paint by means of high-speed rotary atomizers and direct charging or contact charging, having a grounded ring main system for supplying the paint to the spraying elements. A paint storage vessel is inserted between the ring main and the paint spraying element. The ring main leads, upstream of the paint storage vessel, into a change-over mechanism which provides an insulation section between the ring main and two adjoining distribution lines.

The paint storage vessel is subdivided into its interior by a flexible insulation, the area of which corresponds to the inner periphery of one half of the paint storage vessel. The flexible insulation divides the paint storage vessel into two mutually insulated parts and two resulting interior spaces which adjoin both lines connected to the spray system.

The paint storage vessel may consist of plastic.

Expressed in other words, the invention proposes that the usually grounded ring main is connected, with the interposition of an electrically insulating change-over mechanism, to two distribution lines which are connected to the interior of a paint storage vessel. In the interior of this paint storage vessel, a flexible insulation is provided which subdivides the interior region of the paint storage vessel into two interior vessel spaces. The flexible insulation is here of such a size that it can adapt itself to the inner wall of the paint storage vessel in one position or in the other position. The paint storage vessel is thus subdivided, also with respect to its two vessel shell parts, by the flexible insulation into two regions which are mutually separated electrically.

This is a static seal which can be electrically isolated. In contrast thereto dynamic seals cannot be electrically isolated.

The two interior spaces, thus provided, of the paint storage vessel are adjoined by two paint supply lines which are fitted at their ends with the high-speed rotary atomizer.

The mode of operation of this arrangement is as follows:

By appropriate setting of the change-over mechanism, one of the two distribution lines is connected to the ring main, and the interior space of the paint storage vessel, located in the region of the end of this distribution line, can then be filled with paint material, the paint supply line connected to this interior space being closed. In this way, the entire vessel is filled via the ring main with paint material and the flexible insulation adapts itself in the vessel to the inner wall of that vessel part which is not connected to the distribution line connected to the ring main.

When the vessel has been filled, the change-over mechanism is changed over, and paint material is then supplied from the ring main into the interior space of that vessel which so far has not been filled with paint material, the pressure in the ring main having the effect that the flexible insulation exerts a force on the paint present in the vessel. When the previously closed paint supply line is then opened, the pressure from the ring main via the distribution line, with the interposition of the flexible insulation, forces the paint material present in the vessel through the first paint supply line outwards to the high-speed rotary bell, that paint supply line then being closed which adjoins the interior space which is connected at this time to the ring main by opening of the change-over mechanism.

It can be seen that an electric isolation of potential is ensured at all times by the insulating section in the change-over mechanism and via the flexible insulation in the vessel, the pressure of the material in the ring main being sufficient for feeding the paint to the high-speed rotary atomizers.

It is important here to note that such vessels can be made in any desired size and that they are then a constituent of the ring main, but it is also possible that the vessels are made in a small size and can thus become a constituent of the paint supply lines or of the high-speed rotary atomizers.

BRIEF DESCRIPTION OF THE DRAWING

The invention is described in detail with reference to FIG. 1 which is a cross-sectional schematic diagram of an embodiment of the invention.

An illustrative example of the invention is explained below by reference to the drawing. In the drawing, 1 marks a ring main, at the end of which a changeover mechanism 2 is arranged. The two branches of the change-over mechanism are connected to distribution lines 3 and 4 which end in a paint storage vessel 5. In the illustrative example shown, this paint storage vessel 5 is represented as a sphere or cylinder, but this is not absolutely necessary, and the size should be adapted to the consumption rate. Within the paint storage vessel 5, and dividing the wall of the paint storage vessel 5 into two parts mutually insulated electrically, a flexible insulation 6 is provided which is of such a size that it is capable of adapting itself to the inner wall of the paint storage vessel 5. The flexible insulation 6 is here located in the middle between the two paint storage vessel parts. Two mutually insulated vessel shell parts 7 and 8 and two mutually insulated vessel interior spaces 9 and 10 are created in this way.

Paint supply lines are connected to these interior spaces 9 and 10, a paint supply line 11 adjoining the interior space 9 and a paint supply line 12 adjoining the interior space 10, which lines lead to the actual high-speed rotary atomizers-which are not shown in the drawing.

In the drawing, one position of the change-over mechanism 2 is indicated by the arrows P, in such a way that the paint material coming from the ring main 1 is fed via the distribution line 3 to the interior space 9 of the paint storage vessel 5. In this state, a valve provided in the paint supply line 11 is closed and a valve provided in the paint supply line 12 is open. Within the paint storage vessel 5, the interior space 10 formed on the other side of the flexible insulation 6 is filled with paint material, so that the pressure of the ring main then acts via the distribution line 3 on the outside of the flexible insulation 6, so that the latter is capable of forcing out the actual material present in the interior space 10 by the paint supply line 12.

When the flexible insulation 6 has reached a position which is the converse of that shown in the drawing, a change-over mechanism 2 is changed over. In the meantime, the interior space 9 has been filled with paint material, and the interior space 10 has been emptied and, by changing over the change-over mechanism 2, a pressure is now exerted via the distribution line 4 upon the other outside of the flexible insulation and, after the valve provided in the paint supply line 11 has been opened, the paint material then present in the interior space 9 is forced out of the paint supply line 11, while the valve provided in the paint supply line 12 is closed.

I claim:

1. A device for applying water-borne paint by means of high-speed rotary atomizers and direct charging or contact charging, comprising:

a grounded ring main system for supplying the paint to said high-speed rotary atomizers;

a paint storage vessel inserted between the ring main system and said high-speed rotary atomizers;

a pair of distribution lines adjoining the paint storage vessel, and a change-over mechanism which provides an insulation section between the ring main system and the two adjoining distribution lines;

said ring main system leading, upstream of the paint storage vessel, into said change-over mechanism, and said paint storage vessel being subdivided in its interior by a flexible insulation, the area of which corresponds to the inner periphery of one half of the paint storage vessel, the flexible insulation dividing the paint storage vessel into two mutually insulated parts, and the two resulting interior spaces of the paint storage vessel adjoining booth lines connected to a spray system.

2. A device as claimed in claim 1 wherein the paint storage vessel consists of plastic.

3. A device as claimed in claim 2 or 1 wherein the flexible insulation divides the paint storage vessel into two vessel shell parts which are mutually insulated electrically.

4. A device as claimed in claim 2 or 1 wherein an electrically effective insulation section is provided in the change-over mechanism.

* * * * *